US009770733B2

(12) United States Patent
Lariviere

(10) Patent No.: US 9,770,733 B2
(45) Date of Patent: Sep. 26, 2017

(54) NOZZLE CHANGER

(71) Applicant: WET, Sun Valley, CA (US)

(72) Inventor: Don Lariviere, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/214,543

(22) Filed: Mar. 14, 2014

(65) Prior Publication Data

US 2014/0263755 A1 Sep. 18, 2014

Related U.S. Application Data

(60) Provisional application No. 61/801,684, filed on Mar. 15, 2013.

(51) Int. Cl.
*B05B 17/08* (2006.01)
*B05B 1/16* (2006.01)

(52) U.S. Cl.
CPC ..... *B05B 17/08* (2013.01); *B05B 1/169* (2013.01)

(58) Field of Classification Search
CPC ... B05B 1/1636; B05B 1/1645; B05B 1/1654; B05B 1/1663; B05B 17/08; B05B 1/169
USPC ..... 239/17, 390–395, 600
See application file for complete search history.

(56) References Cited

U.S. PATENT DOCUMENTS 6,398,134 B1 * 6/2002 Hickson et al. ..... 239/394
6,651,909 B1 * 11/2003 Bugarin ..... B08B 3/026 239/390
2009/0181838 A1 * 7/2009 Schmauder ..... 483/58

* cited by examiner

*Primary Examiner* — Christopher Kim
(74) *Attorney, Agent, or Firm* — Maceiko IP

(57) ABSTRACT

A nozzle changing device to remove and attach nozzles to a water shooting device is described. The device allows for removal and attachment of various nozzles on a water shooting device during or after a water display without the need for a technician to manually change the nozzles. The device may be independent or attached to the water shooting device.

13 Claims, 2 Drawing Sheets

NOZZLE CHANGER

CROSS REFERENCE TO RELATED APPLICATION

The application claims the benefit of U.S. Provisional Application No. 61/801,684, filed Mar. 15, 2013, the contents of which are incorporated herein by reference.

FIELD OF THE INVENTION

The present invention relates generally to water displays and equipment used therein, including a nozzle changing device that may change the output nozzle on a water delivery device.

BACKGROUND OF THE INVENTION

Various water displays exist along with their associated equipment such as water delivery devices that shoot water into the air. These water delivery devices typically include an exit nozzle that has a certain configuration. Accordingly, the configuration of the water stream shot out of a given water delivery device will generally be dictated by the configuration of the exit nozzle.

If it is desired to change the configuration of a water stream shot out of a water delivery device, the nozzle fitted onto that water delivery device must be changed. This may involve significant work. For example, many water delivery devices are located in a large reservoir, so changing the nozzle may involve draining the reservoir or changing the nozzle as it remains underwater. And if the nozzle on a number of water delivery devices must be changed, significant effort may be involved.

Accordingly, there is a need in the field of water displays for a device that may automatically change the nozzles on a water delivery device without the need for an individual physically changing the nozzle. Furthermore, there is a need for a device that may provide several different nozzles to choose from when automatically changing the nozzle.

SUMMARY OF THE INVENTION

In an aspect of the invention, an automatic nozzle changing device is described. The device may store one or more nozzles that may serve as replacement nozzles for a water delivery device. The nozzle changing device may have the ability to remove a nozzle from the water delivery device, store it, and then provide a replacement nozzle to the water delivery device.

In another aspect of the invention, because the nozzle changing device may provide one or more replacement nozzles to the water delivery device, the nozzle changing device also provides the ability for the water delivery device to emit different configurations of water display streams.

In another aspect of the invention, the nozzle changing device avoids a labor intensive process that may be currently associated with manually changing nozzles.

DETAILED DESCRIPTION OF THE PREFERRED EMBODIMENTS

Figure 1:
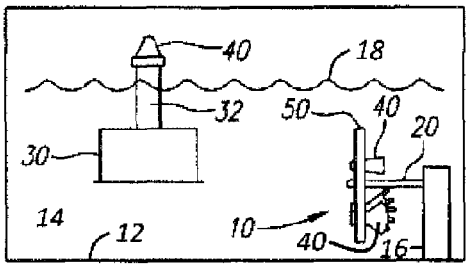
FIG. 1 is a side view of a water delivery device and a nozzle changing device.

The nozzle changing device 10 of the current invention is now described with reference to the figures. Components appearing in more than one figure bear the same reference numerals.

FIGS. 1-5 are a series of figures that depict the nozzle changing process. Nozzle changing device 10 may include various components such as rotation arm 20, one or more nozzles 40, nozzle storage plate 50, and control device (not shown). The size of the nozzle changing device may vary depending on the number and size of nozzles 40 and the size of the water delivery device 30.

Nozzle changing device 10 may be mounted to the bottom 12 of the reservoir 14 of water display. Changer 10 may be located in proximity to the water delivery device(s) 30 that it is intended to service. Changer 10 may include a suitable frame 16 that may serve to anchor changer 10 to the reservoir floor 12. The frame 16 may also hold rotation arm 20, control device 60 and other components in place.

As shown in FIG. 1, water delivery device 30 may originally be positioned so that its nozzle 40 is directed upward and located above the reservoir 14 water surface 18. As also shown, nozzle changer 10 is located in proximity to water delivery device 30.

Nozzle storage holder or plate 50, which may house one or more replacement nozzles, may be mounted to arm 20. Arm 20 may rotate axially so that the desired replacement nozzle may be aligned with water delivery device 30. Arm may be extended and retracted along its axis. Nozzle storage holder or plate 50 may be connected to arm 20 so that when arm 20 rotates, so does storage holder 50. Further, nozzle storage holder 50 may be connected to spinning arm 20 such that when spinning arm 20 is extended or retracted, nozzle storage plate 50 is also extended or retracted. The movement of arm 20 and holder or plate 50 may occur under computer control so that a technician need not physically replace nozzle 40.

Figure 6:
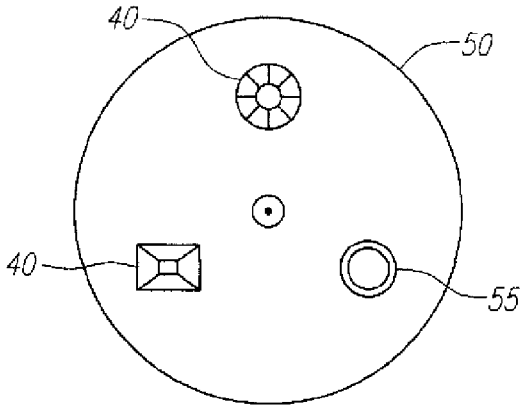
FIG. 6 shows a nozzle storage holder such as a plate.

As shown in FIG. 6, nozzle storage plate 50 may comprise slots 55 which may store one or more nozzles 40. Generally, nozzle storage holder or plate 50 may have at least one empty slot 55 which may be used to remove the nozzle 40 currently on the water delivery device 30, and then store that removed nozzle 40 for future use. Nozzle storage holder or plate 50 may include a device (not shown) to remove and replace nozzle 40 from water shooter 30.

The steps that may occur during a nozzle replacement are now discussed with reference to FIGS. 1-5. Generally, nozzle changer 10 may remove nozzle 40 from water delivery device 30 and replace it with a different nozzle 40.

As shown in FIG. 1, water delivery device 30 may originally be positioned so that its nozzle 40 is directed upward and located above the reservoir water surface. As also shown, nozzle changer 10 is located in proximity to water delivery device 30.

Figure 2:
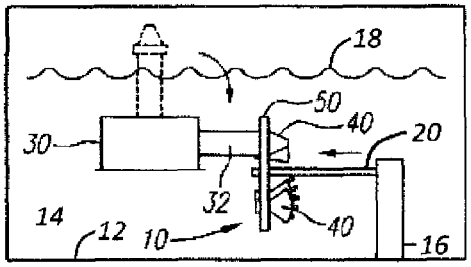
FIG. 2 is a side view of a nozzle changing removing the nozzle from the water delivery device.

When it is desired to change nozzle 40, as shown in FIG. 2, the outlet pipe 32 and nozzle 40 may swing down to a position under water. Arm 20 may travel toward water delivery device 30. Spinning arm 20 may rotate so that an available slot 55 on nozzle storage holder 50 aligned with nozzle 40 currently attached to water delivery device 30.

Nozzle storage holder 50 may then remove nozzle 40 from water shooter 30. This may occur in various ways. For example, nozzle 40 may be locked to outlet pipe 32 by a locking device that may be unlocked by the engagement between nozzle 40 and holder 50 and/or open slot 55.

Figure 3:
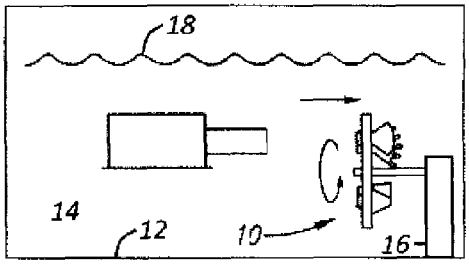
FIG. 3 is a side view of a water delivery device and nozzle changing device after the changing device has removed the nozzle.

After nozzle 40 is unlocked from outlet pipe 32, it may be housed by slot 55 in holder 50. At this point, arm 20 may retract as shown in FIG. 3. At or around the same time, arm 20 and plate 50 may rotate so that the desired replacement nozzle 40 housed in another slot 55 of holder 50 is aligned with outlet pipe 32.

Figure 4:
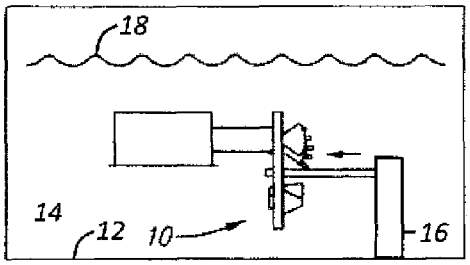
FIG. 4 is a side view of the nozzle changing device installing a replacement nozzle on the water delivery device.
Figure 5:
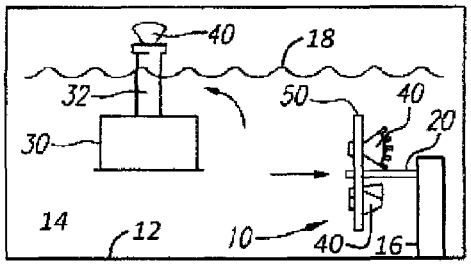
FIG. 5 is a side view of a water delivery device and a nozzle changing device after the nozzle has been changed.

Arm 20 may then extend towards water delivery device with replacement nozzle 40 aligned with outlet pipe 32. Arm 20 may continue to extend until replacement nozzle 40 engages outlet pipe 32 and is locked thereon as shown in FIG. 4. Outlet pipe 32 and newly installed replacement nozzle 40 may then return to its active position above the reservoir 14 surface 18. Arm 20 and changing holder or plate 50 may retract into or towards changer 10.

Nozzle 40 may comprise many available nozzles, including but not limited to round streams, narrow fans, wide fans, conical nozzles, and others that have not yet been anticipated. To this end, it is preferred that existing and future nozzles share a common characteristic so that they may all accommodate water delivery device 30 and changer 10. Some nozzles 40 may themselves have moveable components that may allow these nozzles 40 to couple into actuators on water delivery device 30.

Slots 55 for nozzles 40 may be equidistant from the axis of rotation of nozzle changing device 10 such that when spinning arm 20 rotates causing nozzle storage holder or plate 50 to rotate, the replacement nozzle 40 will be aligned with outlet pipe 32. Nozzle changing device 10 may comprise a material that may provide protection from liquid filled environments.

Figure 7:
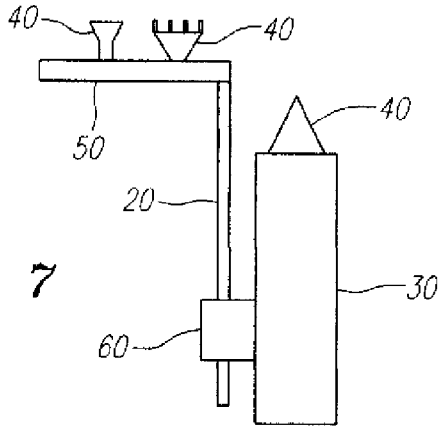
FIG. 7 shows an alternate embodiment of a nozzle changing device.
Figure 8:
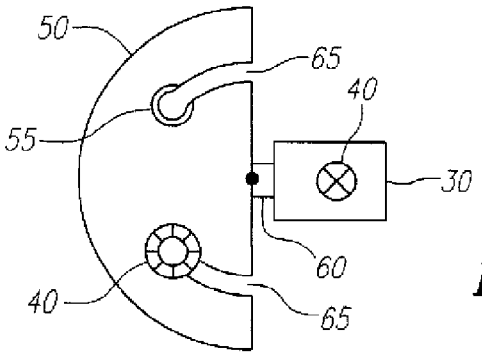
FIG. 8 shows a nozzle changing holder or plate.

In another embodiment of the invention, nozzle changing device 10 may be directly attached to water shooter 30 as shown in FIGS. 7 and 8. Control device 60 may be fixed to water delivery device 30 so as to allow arm 20 to rotate the nozzle storage holder or plate 50. In this embodiment, nozzle storage holder 50 may be smaller in size so as not to interfere with water exiting water shooter device 30 during water displays.

Control device 60 and spinning arm 20 may be placed on water shooter 30 such that nozzle storage plate 50 may retreat below nozzle 40 and the surface 18 of the reservoir 14 to prevent nozzle storage holder 50 and additional nozzles 40 from being seen.

A possible design for removal and reattachment is now described. Nozzle storage plate 50 may comprise unfilled tracks 65 such that nozzle storage plate 50 may be rotated with nozzle 40 of water shooter 30 entering unfilled track 65. Nozzle storage holder or plate 50 may be extended away from water shooter 30 thereby removing nozzle 40 from water shooter 30. Nozzle storage holder or plate 50 may then rotate to place another nozzle 40 over water shooter 30 and retract towards water shooter 30 to attach new nozzle 40.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A nozzle changing device for changing a nozzle attached to a water delivery device, comprising:

a holder that is located below a surface of a body of water and that includes at least two slots or tracks for receiving and releasably holding one or more nozzles, with at least one of the slots or tracks being empty to receive the nozzle attached to the water device;

one or more replacement nozzles releasably held in the slots or tracks; and an arm operably coupled to the holder that moves axially and radially to move the holder under the surface of the body of water to thereby change the nozzle attached to the water delivery device.

2. The nozzle changing device of claim 1, wherein the holder is coupled to the arm such that the movement of the arm causes the holder to move adjacent to the water delivery device, receive the nozzle attached to the water delivery device in the empty slot or track, and replace the nozzle with a replacement nozzle.

3. The nozzle changing device of claim 1, wherein the arm is movable axially to move the holder toward and away from the water delivery device and radially to rotate the holder to position one of the slots or tracks in alignment with the water delivery device.

4. The nozzle changing device of claim 1, wherein the holder is circular plate.

5. The nozzle changing device of claim 4, wherein the arm is coupled to the holder at or near the center of the circular plate.

6. The nozzle changing device of claim 1, wherein each of the replacement nozzles is configured to provide a different water stream when attached to the water delivery device.

7. The nozzle changing device of claim 1, wherein the arm is movably coupled to the water delivery device.

8. The nozzle changing device of claim 1, further comprising:

a control device for controlling the movement of the arm.

9. The nozzle changing device of claim 1, wherein the body of water is contained within a reservoir.

10. The nozzle changing device of claim 9, wherein the reservoir has a bottom floor and the nozzle changing device is coupled to the bottom floor.

11. The nozzle changing device of claim 10 further comprising a frame that is coupled to the bottom floor that supports the nozzle changing device.

12. The nozzle changing device of claim 1, wherein the holder is always located under the surface of the body of water.

13. The nozzle changing device of claim 1, wherein the arm moves the holder from the first position to a position that is above the surface of the water to change the nozzle.

* * * * *